US005308240A

United States Patent [19]

Lowenthal

[11] Patent Number: 5,308,240

[45] Date of Patent: May 3, 1994

[54] FLAME LIGHTER

[75] Inventor: Hans Lowenthal, London, England

[73] Assignee: Colibri Lighters Limited, England

[21] Appl. No.: 949,621

[22] PCT Filed: May 28, 1991

[86] PCT No.: PCT/GB91/00838

§ 371 Date: Nov. 27, 1992

§ 102(e) Date: Nov. 27, 1992

[87] PCT Pub. No.: WO91/19134

PCT Pub. Date: Dec. 12, 1991

[30] Foreign Application Priority Data

Jun. 1, 1990 [GB] United Kingdom ..... 9012202
Jul. 19, 1990 [GB] United Kingdom ..... 9015880

[51] Int. Cl.[5] ..... F23Q 2/08

[52] U.S. Cl. ..... 431/131; 431/132; 431/255; 431/150

[58] Field of Search ..... 431/130, 131, 132, 255, 431/150, 277

[56] References Cited

FOREIGN PATENT DOCUMENTS

0410313A1 1/1991 European Pat. Off. .
2017795 9/1969 France .
2627848 9/1989 France .
1117457 8/1989 Japan .
1452264 10/1976 United Kingdom .

*Primary Examiner*—Carroll B. Dority
*Attorney, Agent, or Firm*—Bruce L. Adams; Van C. Wilks

[57] ABSTRACT

A flame lighter has a blue flame burner and a luminous flame burner supplied with gaseous fuel from a reservoir through separate valves, and a single ignition mechanism. A first operation ignites the blue flame burner and a second operation opens the valve for the luminous flame burner so that the luminous flame is ignited from the heat of the blue flame burner, whenever a luminous flame is desired.

19 Claims, 7 Drawing Sheets

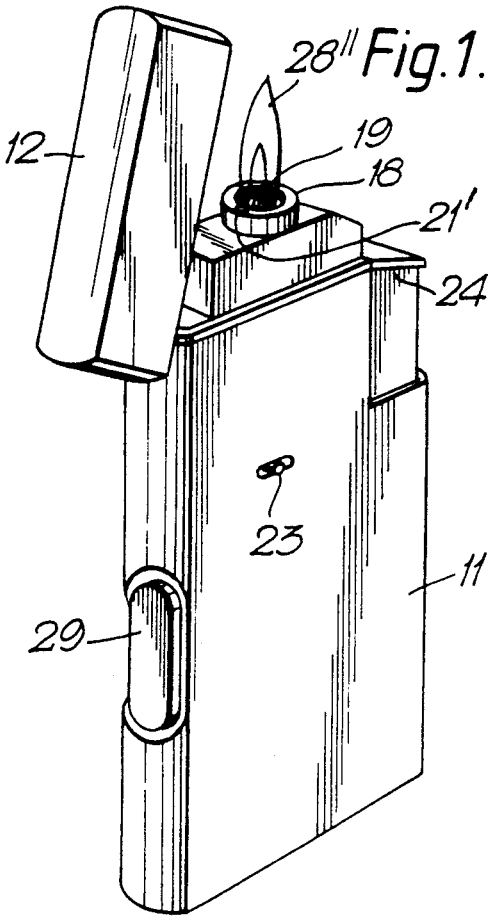
Fig. 1.
Fig. 2.
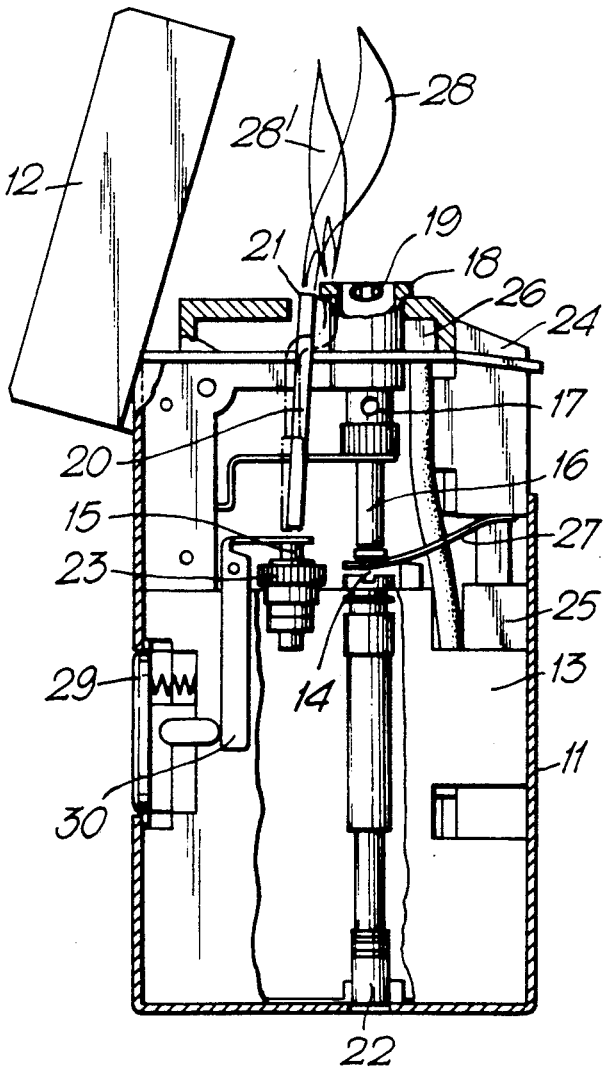

FLAME LIGHTER

Conventional pocket or table flame lighters, which are used for lighting cigarettes and other smoking material, and for other purposes, such as for lighting candles and for providing occasional illumination, have a burner which provides a low intensity, luminous flame of yellowish colour and appreciable height, but subject to vagaries of local air draughts and winds. Accordingly, a lighter with such a burner is more suitable for use indoors and the willowy flame is aesthetically pleasing.

In recent years flame lighters have been developed with a "blue" flame burner, that is to say a burner which is supplied with gaseous fuel and an excess of air, so that the fuel burns, in the manner of a Bunsen burner, with a fierce, very hot, not very visible, flame, which is often, but not necessarily, blue in colour, the flame impinging on an exposed glow element of metal, ceramic, or other suitable material, such as a coil or grid, which is consequently rendered at least red hot. Such lighters, which have been described as "flameless" or "turbo" lighters, find particular use as sports lighters out of doors, since the intense flame ensures continuous burning, even in relatively high winds, and total windproofness due to re-ignition of the gaseous fuel, were it otherwise to be blown out by the wind, particularly if the glow element is made of platinum, which provides a catalytic effect in initiating re-ignition of the fuel gas. However, lighters with a blue flame burner have the disadvantage that the intense heat from the blue flame makes it difficult for the user to hold the lighter with the flame burning for more than a quarter of a minute or so, and the absence of an elongate luminous flame, makes it difficult to use the lighter for ancillary purposes, such as lighting candles, providing transient illumination, or lighting cigarettes for other people.

In accordance with the present invention, a flame lighter comprises a casing containing at least one reservoir for liquefied gaseous fuel; a first, blue flame burner, which is arranged to be supplied with gaseous fuel from the, or one of the, reservoir(s) through a first valve; a manually operated ignition mechanism for igniting the fuel at the first burner so that the fuel burns near to a glow element which is thus heated by the blue flame; and a second, luminous flame burner, which is arranged to be supplied with gaseous fuel from the, or another of the, reservoir(s) through a second valve; a nozzle of the second burner being adjacent to the first burner so that the fuel at the second burner is ignitable by heat generated at the first burner whenever the first burner is burning and the second valve is open, and the first valve then being closable when the second valve remains open so that only the luminous flame continues to burn. Preferably the lighter can be used in any one of three modes in which one or other, or both, of the burners is or are burning.

With this arrangement, the benefits of an indoor lighter, with a luminous flame burner, and of the outdoor lighter with a blue flame burner are simultaneously obtained with a single ignition mechanism. In practice the only duplication involves the use of a single second burner valve and nozzle and the means to open the second burner valve, and these are cheap components.

The essential difference between the first, blue flame burner, and the second, luminous flame burner, is that the respective air inlet which provides oxygen for nourishing the combustion of the fuel is arranged to provide more air for the first burner than for the second burner, usually by throttling and accelerating the gas flow to the blue flame burner and using a venturi to draw in the air.

In practice, the first valve will be opened and the ignition mechanism operated to ignite the blue flame, and if it is needed, the second valve will be opened, before, substantially simultaneously with, or after, opening of the first valve, so that the yellow flame is ignited as a result of its proximity to the blue flame and/or to the red hot glow element. The arrangement is such that control of the fuel flow to the burners is such that after having been lit from the first burner the luminous flame at the second burner can continue to burn with the blue flame at the first burner extinguished. Thus the first valve is closable with the second valve open so that only the luminous flame burns. But if the first valve is not closed, both flames may continue to burn, thus ensuring reignition of the luminous flame by the first burner if necessary.

The first valve may be opened, for example, in conventional fashion by opening of a casing lid to expose externally visible parts of the burners. The ignition mechanism may then be operated by a first manually operable actuating member, such as a depressible trigger which operates a piezo-electric sparking mechanism. Alternatively, the first actuating member may move against spring action both to open the first valve and to operate the ignition mechanism, release of the first actuating member causing closure of the first valve. The second valve may be operated by a second independently manually operable actuating member which must be displaced for the opening of the second valve.

There may be an impediment which prevents the second actuating member from being displaced for opening of the second valve until the impediment has been manually moved to a non-impeding position. The impediment may be, for example, a part which has to be moved to provide access to the second actuating member, or a safety interlock which prevents opening of the second valve unless a lid has been opened or some catch has been physically moved.

Most simply, the second actuating member is displaceable against spring action to open the second valve, and the second actuating member must be manually held displaced to keep the second valve open.

Alternatively, the second actuating member may be retained automatically by interference means in its displaced position necessary for the opening of the second valve until positively released from the displaced position. In one such construction, the second actuating member is movable against spring action from a rest position to its displaced position for the opening of the second valve, and when the second actuating member reaches its displaced position an interlock element forming the interference means is automatically movable under spring action to hold the second actuating member in its displaced position, the interlock element being manually movable against its spring action to release the second actuating member and allow the second actuating member to return under its spring action to the rest position at which the second valve is always closed.

It is therefore apparent that the lighter may take various forms. Thus, the first and second actuating members may be adjacent to one another so that the user's thumb or finger naturally actuates the first actuating member to ignite the blue flame, and then, optionally, rides onto the second actuating member to open the second valve and cause ignition of the luminous flame. At the same time the first actuating member may be released so that the first valve is closed and the blue flame is extinguished. Alternatively, if the first valve is opened by, for example, opening a casing lid, the restraint maintaining the first valve open may automatically be released, so that the first valve is closed, when the second actuating member is actuated to open the second valve.

In an alternative construction, the second actuating member, for opening the second valve, may be remote from the first actuating member, which causes ignition of the blue flame, so that opening of the second valve to provide the fuel supply for the luminous flame requires a different positive movement to operate the second actuating member. In this case, the first actuating member may be a depressible plunger adjacent to the top of the lighter and arranged to be actuated by the user's thumb, whereas the second actuating member may be a depressible button, a slide, or other part operable at a remote side of the casing by one or more of the user's fingers. This construction has the advantage that whilst the luminous flame is kept alight the user's fingers can be positioned far from the flame, making it ideal for the ancillary purposes previously referred to.

In another construction, the second valve is opened by a second actuating member, such as a button or slide, which may be position almost anywhere on the lighter, after a casing lid has been opened, the valve being held open by a retaining element. Alternatively, actuation of the second actuating member may enable the lid to open the second valve when the lid is subsequently opened, the valve again being held open by a retaining element. In either case the blue flame, and hence the luminous flame can then be ignited by actuating the first actuating member to open the first valve and operate the ignition mechanism. Release of the first actuating member will then close the first valve and extinguish the blue flame, leaving burning the luminous flame, which may subsequently be extinguished by closing the lid. This requirement is satisfied by a construction wherein the second actuating member is movable to and from, and retainable in, its displaced position independently of the opening and closing of a hinged lid of the lighter, the second actuating member and the like both cooperating with the second valve such that the valve is only open whilst the second actuating member is in its displaced position and the lid is open. In such an arrangement the lid and second actuating member may cooperate with the second valve via a rocking lever, a mid portion of which is engagable with the second valve and the ends of which are respectively acted upon by the lid and second actuating member such that when a) the lid is open one end of the lever is constrained displaced in one direction, when b) the second actuating member has been displaced the other end of the lever is constrained displayed in the one direction, and when both a) and b) obtain the lever is held bodily displaced in the one direction such that the mid portion holds the second valve open.

The interference means may be caused to release the second actuating member upon closing of the hinged lid of the lighter.

The invention can also be effected by a construction in which the lighter comprises a two stage manually operable actuating member, which, upon actuation in a first stage opens the first valve and operates the ignition mechanism and, upon actuation in a second stage, opens the second valve and thereafter closes the first valve. In the first stage, the actuating member may move against a weaker spring to rock a first lever to open the first valve and, in the second stage, move against a stronger spring, to rock the and/or another lever to open the second valve and therafter to close the first valve.

With this arrangement the two stage movement is sensed by the use of the stronger and weaker springs, the manual force applied to the actuating member acting through the stronger spring to overcome the weaker spring in the first stage movement, and, thereafter, overcoming the stronger spring during the second stage movement. For example, a conventional piezo-electric ignition mechanism with its usual spring loaded plunger may be covered by a cup with an interposed stronger return spring, the first stage movement of the actuating member causing the cup and stronger spring to depress the ignition mechanism plunger whilst the first lever is rocked to open the first valve. Thereafter, when the piezo-electric ignition mechanism plunger has bottomed out, further movement of the actuating member overcomes the action of the stronger spring so that the cup moves relatively to the piezo-electric ignition mechanism plunger and rocks a second lever which opens the second valve, the first lever simultaneously being released so that the first valve is reclosed under its own internal return spring mechanism. The two stage movement may alternatively or additionally be sensed by an obstruction to the movement of the actuating member when the first stage has been completed, the obstruction being overridden when the second stage commences.

The timing is preferably such that the first valve is closed just after the second valve is opened, so that ignition of the luminous flame will be assisted by the temporary existence of the blue flame, and will not depend alone on the heat from the glow element.

A cover for the first burner may be displaceable to reveal the first burner, whilst the second burner has no cover at all and thus is always exposed. Alternatively, a cover for the second burner is displaceable to reveal the second burner upon movement of the second actuating member to its displacement position, or upon movement of the impediment to its non-impeding position.

The second burner nozzle must be sufficiently adjacent to the first burner so that the luminous flame is ignited by the heat from the first burner. This may involve the second burner having a nozzle which directs the gaseous fuel stream, when the second valve is opened, through, adjacent to the edge of, or above the glow element of the first burner. For example, the second burner nozzle may be alongside the first burner and oriented to provide a gas flow in a direction inclined towards the gas flow of the first burner, i.e. over the glow element of the first burner. Alternatively the first burner may have a burner ring surrounding the glow element and the nozzle of the second burner extends through the body of the ring at an edge of the glow element, or to within the ring. The "adjacency" of the second burner to the first burner should be construed to include all these arrangements.

Some examples of lighters constructed in accordance with the present invention are illustrated in the accompanying drawings, in which:

FIG. 1 is a diagrammatic perspective view of a first lighter;

FIG. 2 is a diagrammatic sectional front elevation of the first lighter;

Figure 3:
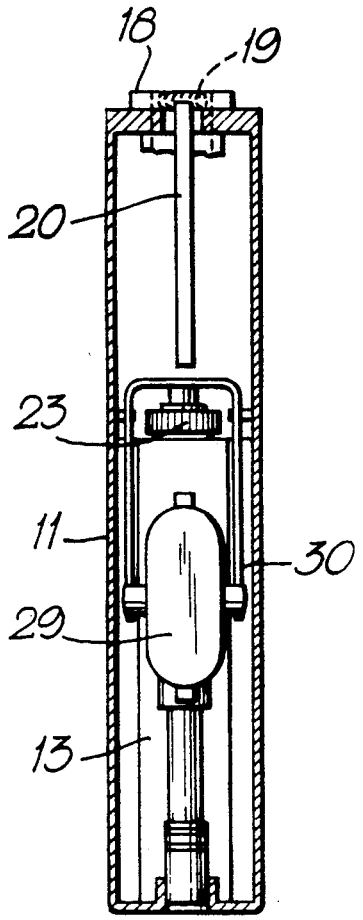
FIG. 3 is a diagrammatic sectional side elevation of the first lighter.

The first lighter, shown in FIGS. 1 to 3 has a casing 11 with a hinged lid 12, the casing containing a liquefied gaseous fuel reservoir 13 having two outlets controlled by first and second valves 14 and 15. The valve 14 controls the flow of gaseous fuel through a conduit 16 in which the flow is throttled and accelerated so that an appreciable quantity of combustion air is drawn in through a venturi inlet 17, the mixture flowing to a blue flame burner consisting of a ring 18 surrounding a glow element 19. The valve 15 controls the flow of gaseous fuel through a conduit 20 to a nozzle 21 of a luminous flame burner alongside or at least partly within the blue flame burner. The valve 14 is adjusted in conventional manner by means of a member 22 accessible at the bottom of the casing 5, whereas the valve 15 is independently adjustable by manipulation of a member 23, which is exposed through a front face of the casing. Alternatively the valve 15 could also be adjusted by means of a member, like the member 22, at the bottom of the casing, as shown for example in FIG. 7.

After opening the lid 12, to expose the burners, and with the casing grasped in the palm of the hand, a trigger actuating member 24 is depressible against spring action to operate a conventional piezo-electric ignition mechanism 25 to discharge a spark at an electrode 26 adjacent to the blue flame burner. Simultaneously, depression of the trigger 24 rocks a lever 27, which opens the valve 14 and provides a gas air mixture at the blue flame burner, which is ignited by the spark. The fierce flame quickly heats the glow element 19 to red heat.

Thereafter a luminous flame 28 may be ignited at the nozzle 21 by depressing against spring action, for example with the middle finger of the hand grasping the lighter, a button 29 which is exposed in a side wall of the casing, and which forms a second actuating member. Depression of the button causes a lever 30 to be rocked counterclockwise as seen in FIG. 2, thereby opening the valve 15 and allowing the discharge of gaseous fuel to the nozzle 21. The fuel mixed with entrained air is quickly ignited by the blue flame and/or the glow element 19 at the blue flame burner.

Thereafter the blue flame may be extinguished by releasing the trigger 24, so that the valve 14 is closed under its own internal spring action. The luminous flame 28 then continues to burn for as long as the button 29 is held depressed, but release of the button causes the valve 15 to be closed under its own internal return spring action, thereby extinguishing the luminous flame as well.

In FIG. 2, the nozzle 21 is shown in full lines alongside and inclined towards the blue flame burner. There is also shown in FIG. 2 in chain dotted lines, a modification of the conduit 20, which is cranked so that the nozzle 21 extends into a hole 21' (ssen in FIG. 1) in the body of the ring 187, and the fuel discharged from this nozzle is even closer to the blue flame burner and will be more readily ignited to form the flame shown at 28' and in FIG. 1. In a further modification, the conduit 20 is cranked to a greater extent so that the nozzle 21 actually lies substantially concentrically within the ring 18 and glow element 19, improving even further the ignition of the flame 28 by the blue flame burner, and producing a central luminous flame 28" as shown in FIG. 1.

Figure 4:
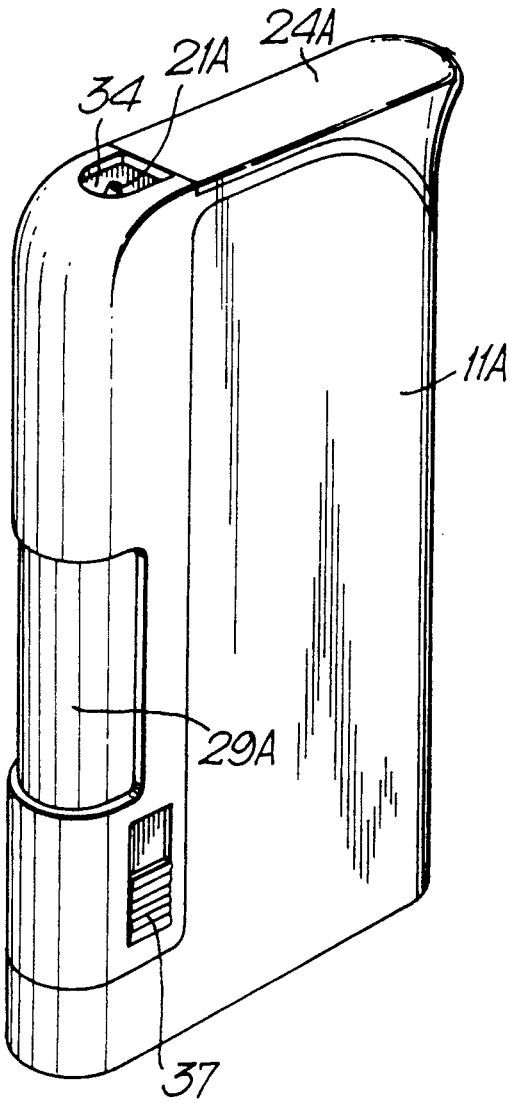
FIG. 4 is a diagrammatic perspective view of a second lighter prior to operation.
Figure 5:
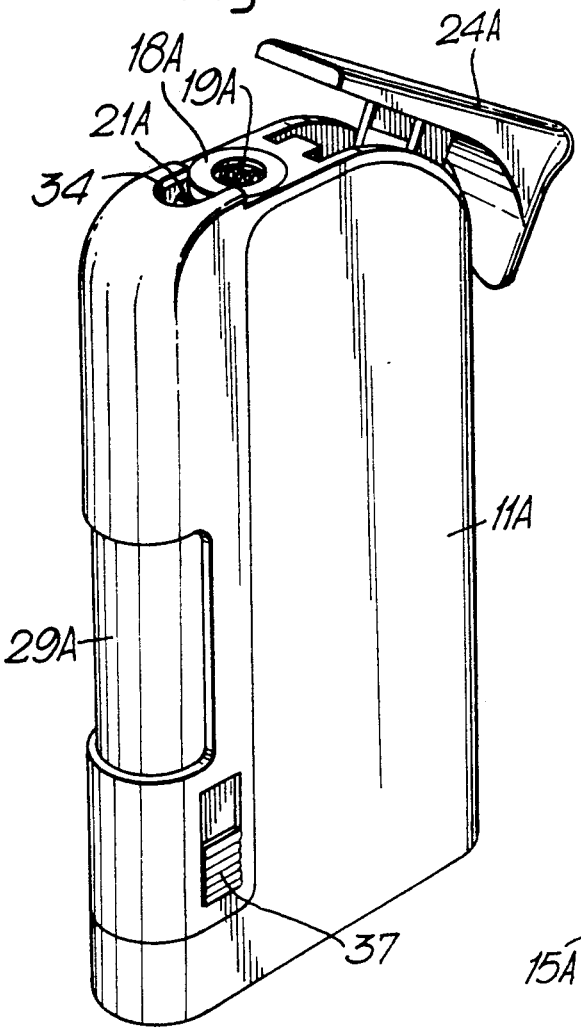
FIG. 5 is a view similar to FIG. 4 but showing the lighter in operation.
Figure 6:
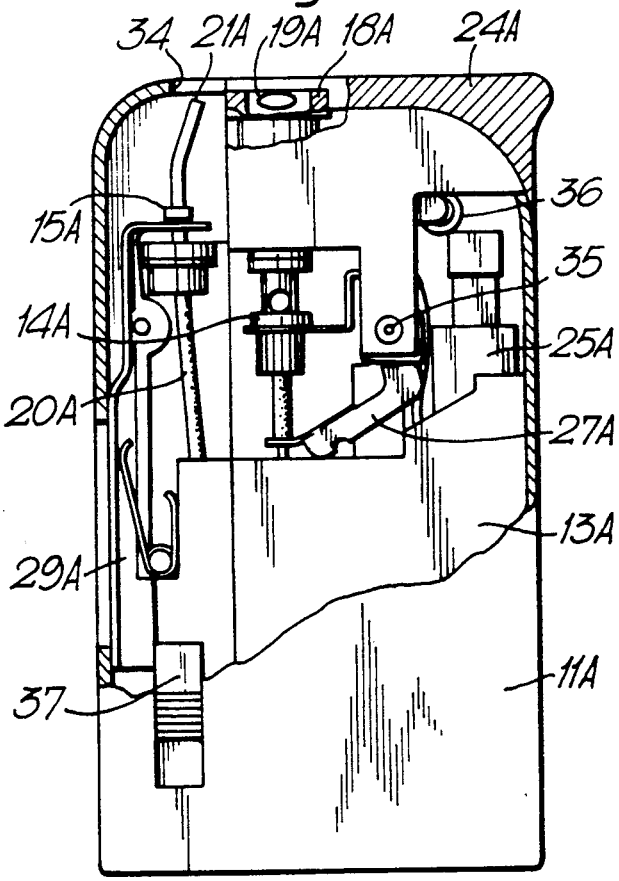
FIG. 6 is a diagrammatic sectional front elevation of the second lighter.

In the second lighter, shown in FIGS. 4 to 6, parts of analogous construction and function to parts of the first lighter are given the same reference numerals with the postscript A.

The second lighter differs from the first in that the nozzle 21A of the luminous flame burner is always exposed in an aperture 34 in the top of the casing and the lid 12 and trigger 24 are replaced by a rotary slide action combined cover and actuator 24A, having legs which are pivoted at 35 relatively to the casing. Thus when the actuator 24A is swung outwards by applying thumb pressure, as shown in FIG. 5, a roller 36 runs onto the top of the plunger of the piezo-electric ignition mechanism 25A to cause the discharge of an ignition spark adjacent to the blue flame burner, and simultaneously rocks a lever 27A to open the first valve 14A. The blue flame continues to burn while the actuator 24A is held in the outward position. A luminous flame is ignited at the nozzle 21A by inward depression against spring action of a lever actuator 29A so that the valve 15A is opened and fuel is discharged from the nozzle 21A adjacent to the blue flame burner. However, there is a sliding interlock element 37, which is exposed in the front face of the casing 11A. In the raised position shown in FIG. 6, it impedes, within the casing, the lower end of the lever 29A, so that the lever cannot be depressed. Depression of this lever is only possible after the element has been slid down to a release position shown in FIGS. 4 and 5.

Figure 7:
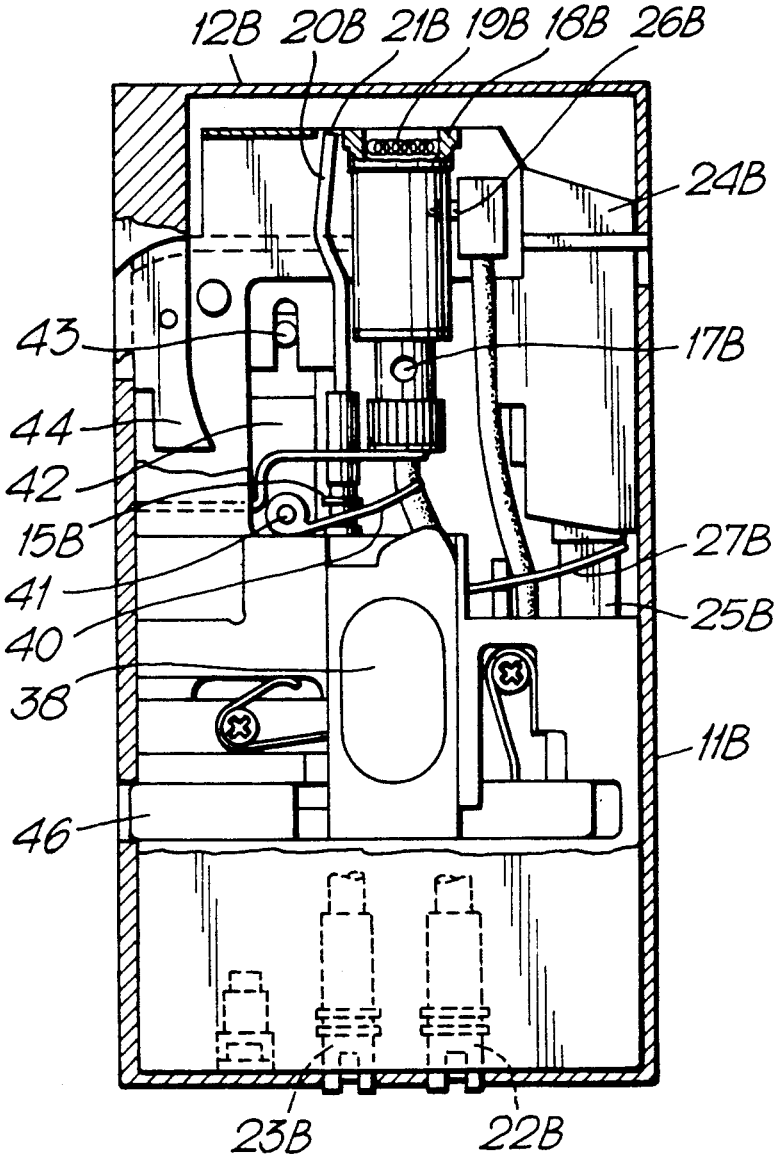
FIG. 7 is a diagrammatic partly sectional front elevation of a third lighter.
Figure 8:
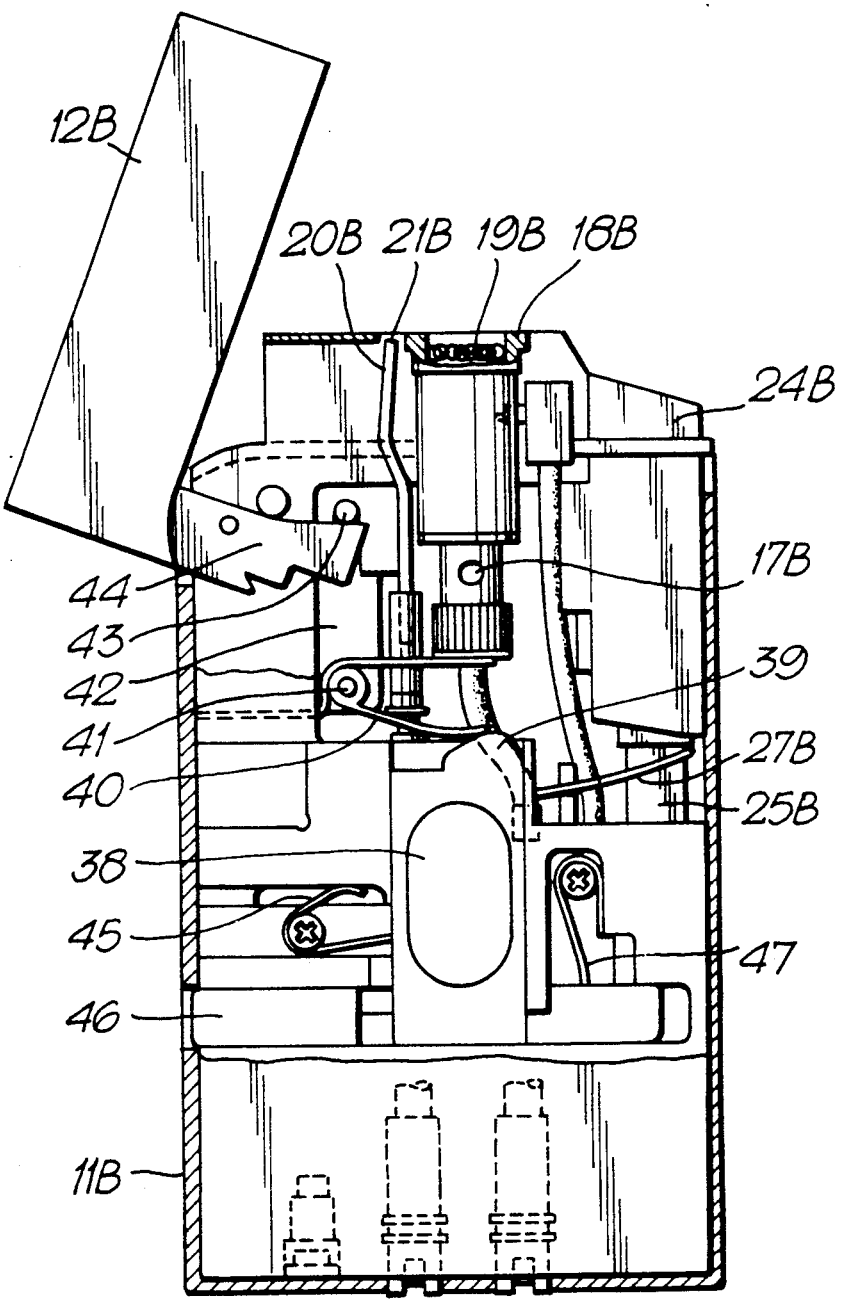
FIGS. 8 and 9 are views similar to FIG. 7 but showing the lighter in different operational modes; and, FIG. 10 is a diagrammatic sectional front elevation of a fourth lighter.
Figure 9:
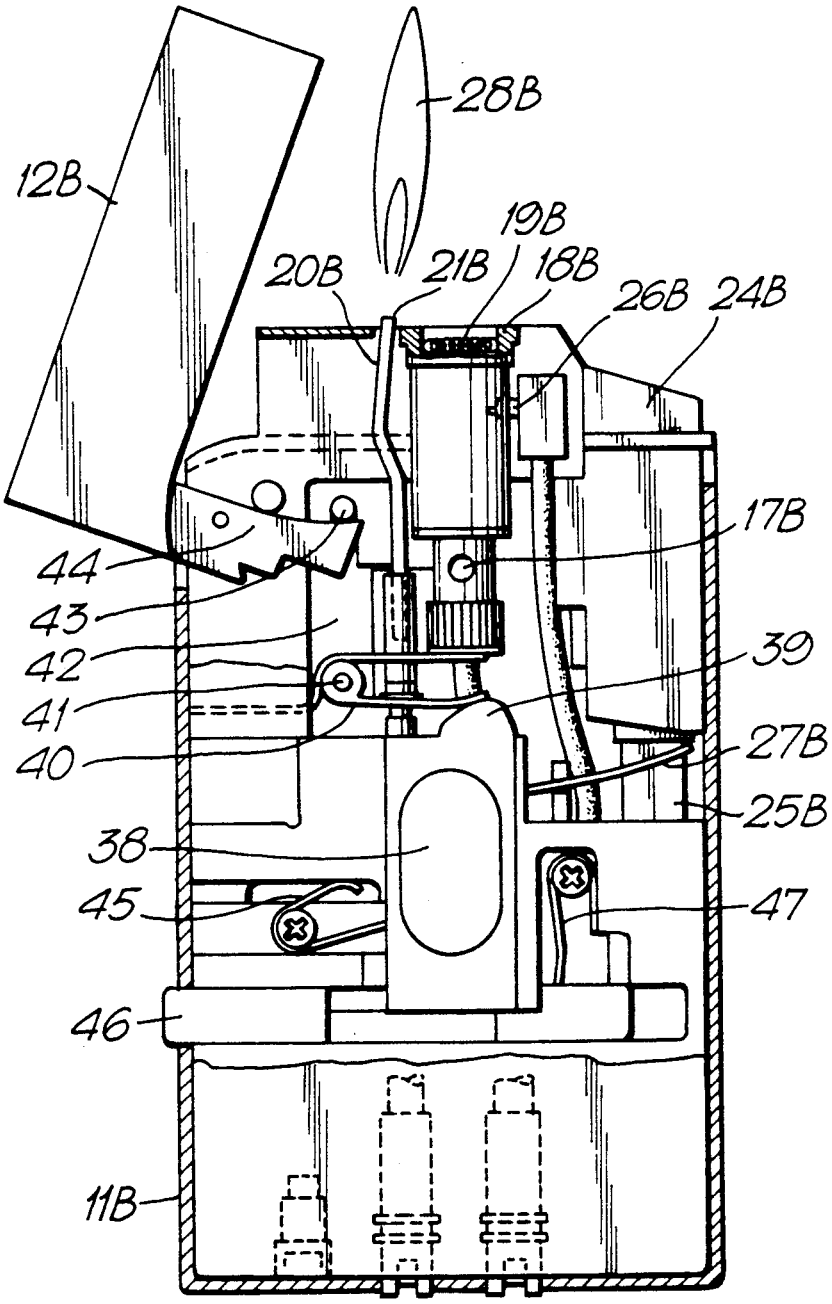

The third lighter is shown in FIGS. 7 to 9 and parts with analogous construction and function to parts of the first two lighters will be given the same reference numerals with the postscript B.

As with the first lighter, with the lid 12B raised, the blue flame burner may be actuated by depressing the trigger actuator 24B, to operate a piezo-electric ignition mechanism 25B so that a spark is discharged at an electrode 26B. At the same time, depression of the trigger rocks a lever 27B, which opens a valve, which is not visible but is similar to the valves 14, 14A so that a fuel/air mixture is discharged to ignite the blue flame in the burner ring 18B, and hence causing the element 19B to glow. The blue flame burner continues burning while the trigger 24B is held depressed and the burner valve held open. When the trigger is released the valve closes under its own internal return spring action and extinguishes blue flame and glowing element.

In this lighter the valve 15B for the luminous flame burner is opened by the joint action of opening the lid 12B and sliding upwards a fingerpiece 38, which is exposed in an opening in the front surface of the casing 11B. The fingerpiece 38 has an upstanding nose 39 which is engagable with the right-hand end of a lever 40, the other end of which is pivoted at 41 to a vertically slidable sub frame 42 having at its upper end a cross pin 43, which is engagable by a curved edge of a depending leg 44 of the lid 12B. A mid portion of the lever 40 is bifurcated and engages both sides of a flange on the valve 15B, the valve being opened when the flange is lifted. The arrangement here is that when the lid 12B is opened, the leg 44 engages the pin 43 and raises the sub frame 42 and with it the pivot 41 and respective end of the lever 40. This in itself is insufficient to raise the flange of the valve 15B and open the valve, unless the fingerpiece 38 has also been raised from its lowered position shown in FIGS. 7 and 8 to its raised position shown in FIG. 9. In this case, both ends of the lever 14 have been lifted and the valve will be opened. The sequence of events is immaterial as the valve will be opened irrespective of whether the lid 12B is first opened and then the fingerpiece 38 raised, or vice verse. When the fingerpiece 38 is raised, against the action of a spring 45, a bar like interlock element 46 is automatically slid towards the left as shown in the Figures, under the action of a spring 47, until a shoulder on the bar element lodges beneath the fingerpiece 38, and holds it in its raised position. At this time the left-hand end of the bar element 46, as seen in the Figures, projects outwardly of the edge of the casing 11B. The fingerpiece is thus held in its raised position unless the bar element 46 is manually pressed back into the casing, for example, by thumb pressure applied to its free end, against the action of the spring 47, so that the fingerpiece 38 then freed and forced to its lowered position by its spring 45. In this way, the lighter can be cocked ready for luminous flame operation by leaving the fingerpiece 38 in its raised position. Opening of the lid will then release gaseous fuel from the nozzle 20B and ignition of the blue flame burner by depression of the trigger 24B will immediately light both flames. The luminous flame can then be left burning after releasing the trigger 24B and extinguishing the blue flame, or the luminous flame could be extinguished by lowering the fingerpiece 38 and keeping the trigger 24B depressed. The construction therefore provides a very sophisticated and versatile manner of operation.

Figure 10:
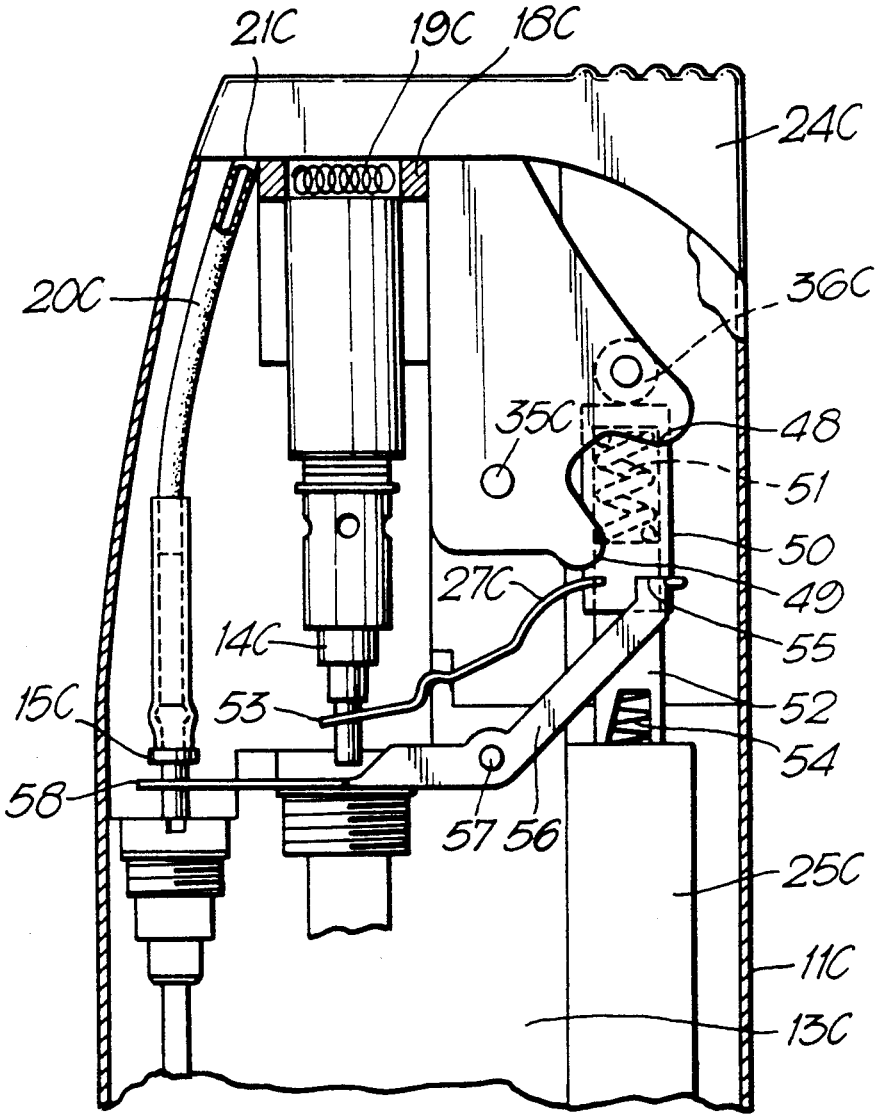

FIG. 10 illustrates the fourth lighter and parts with analogous construction and function to parts of the earlier examples are given the same reference numerals with the postscript C.

The fourth lighter is similar to the second lighter in having a rotary slide action cover and actuator 2 C which has a depending portion pivoted relatively to the casing at 35C. The depending portion carries a roller 36C and first and second cam surfaces 48 and 49. The roller 36C bears on top of an inverted cup 50, which houses a compression spring 51 bearing on top of the plunger 52 of a piezo-electric ignition mechanism 25C.

Upon first stage clockwise movement of the actuator 24C, the cam surface 49 engages the adjacent end of a lever 27C, so that its other end 53 rises and opens the valve 14C for the blue flame burner, whereupon gaseous fuel is released to the burner defined by the ring 18C and glow element 19C, which are then exposed. Simultaneously, the roller 36C depresses the cup 50 and, as the spring 51 is stronger than a return spring at 54 for the plunge 52, the plunger 52 is depressed to operate the ignition mechanism, which causes an ignition spark to be discharged at the conventional electrode adjacent to the glow element 19C to ignite a blue flame. This first stage movement of the actuator 24C is felt to be terminated when the plunger 52 bottoms out. Thereafter, an additional force applied to the actuator 24C, rotates the actuator further in the clockwise direction about the pivot 35C, to overcome the strength of spring 51 and to depress the cup 50 further over the plunger 52. This movement causes the cam surface 48 to engage an end 55 of a lever 56, which is pivoted at 57, so that an end 58 of the lever is raised and opens a valve 15C for the luminous flame burner, whereupon gaseous fuel is discharged through the conduit 20C to the nozzle 21C adjacent to the blue flame burner. Gas discharged from the nozzle 21C is then ignited by the heat from the element 19C and burns as a luminous flame.

During the second stage movement of the actuator 24C the cam surface 49 rides off the upwardly convex portion of the lever 27C so that the lever is no longer able to hold the valve 14C open against its own internal return spring, and the valve is closed, thus discontinuing the flow of gaseous fuel to the glow element 19C. This leaves only the luminous flame from the nozzle 21C burning. This luminous flame is subsequently extinguished when the actuator 24C is released so that the parts return to the rest position under the action of the return spring 51, the return spring 54 acting on the plunger 52, and the return spring in the valve 15C.

I claim:

1. A flame lighter comprising: a casing containing at least one reservoir for liquefied gaseous fuel; a first, blue flame burner, which is arranged to be supplied with gaseous fuel from the, or one of the, reservoir(s) through a first valve; a manually operated ignition mechanism for igniting the fuel at the first burner so that the fuel burns near to a glow element which is thus heated by the blue flame; and a second, luminous flame burner, which is arranged to be supplied with gaseous fuel from the, or another of the, reservoir(s) through a second valve; a nozzle of the second burner being adjacent to the glow element of the first burner so that the fuel at the second burner is ignitable by heat generated at the first burner whenever the first burner is burning and the second valve is open, and means for closing the first valve while the second valve remains open so that only the luminous flame continues to burn.

2. A flame lighter according to claim 1, including means wherein the lighter can be used in any one of three modes in which one or the other, or both, of the burners is or are burning.

3. A lighter according to claim 1 or claim 2, comprising a first manually operable actuating member which operates the ignition mechanism, and means including a second independently manually operable actuating member which must be displaced for the opening of the second valve.

4. A lighter according to claim 3, including means wherein the first actuating member moves against spring action both to open the first valve and to operate the ignition mechanism, release of the first actuating member causing closure of the first valve.

5. A lighter according to claim 3, wherein there is an impediment which prevents the second actuating member from being displaced for opening of the second valve until the impediment has been manually moved to a non-impeding position.

6. A lighter according to claim 3, in which the second actuating member is displaceable against spring action to open the second valve, and the second actuating member must be manually held displaced to keep the second valve open.

7. A lighter according to claim 3, wherein the second actuating member is retained automatically by interference means in its displaced position necessary for the opening of the second valve until positively released from the displaced position.

8. A lighter according to claim 7, wherein the second actuating member is movable against spring action from a rest position to its displaced position for the opening of the second valve, and when the second actuating member reaches its displaced position an interlock element forming the interference means is automatically movable under spring action to hold the second actuating member in its displaced position, the interlock element being manually movable against its spring action to release the second actuating member and allow the second actuating member to return under its spring action to the rest position at which the second valve is always closed.

9. A lighter according to claim 7, wherein the second actuating member includes means wherein it is movable to and from, and retainable in, its displaced position independently of the opening and closing of a hinged lid of the lighter, the second actuating member and the lid both including means cooperating with the second valve such that the valve is only open while the second actuating member is in its displaced position and the lid is open.

10. A lighter according to claim 9, wherein the lid and second actuating member include means to cooperate with the second valve via a rocking lever, a mid portion of which is engagable with the second valve and the ends of which are respectively acted upon by means cooperating with the lid and the second actuating member such that when a) the lid is open one end of the lever is constrained displaced in one direction, when b) the second actuating member has been displaced the other end of the lever constrained displaced in the one direction, and when both condition a) and b) exist the lever is held bodily displaced in the one direction such that the mid portion holds the second valve open.

11. A lighter according to claim 7, wherein the interference means is coupled with means to release the second actuating member upon closing of a hinged lid of the lighter.

12. A lighter according to claim 1, comprising a two stage manually operable actuating member including means, which, upon actuation in a first stage opens the first valve and operates the ignition mechanism and, upon actuation in a second stage, opens the second valve and thereafter closes the first valve.

13. A lighter according to claim 12, wherein the actuating member, in the first stage, moves against a weaker spring to rock a first lever to open the first valve and, in the second stage, moves against a stronger spring, to rock the and/or another lever to open the second valve and thereafter to close the first valve.

14. A lighter according to claim 3, wherein a cover for the first burner is displaceable to reveal the first burner, while the second burner has no cover at all and thus is always exposed.

15. A lighter according to claim 3, wherein a cover for the second burner is displaceable to reveal the second burner upon movement of the second actuating member to its displaced position, or upon movement of the impediment to its non-impeding position.

16. A lighter according to claim 1, wherein a nozzle of the second burner is alongside the first burner and oriented to provide a gas flow in a direction inclined towards the gas flow of the first burner.

17. A lighter according to claim 1, wherein the first burner has a burner ring surrounding the glow element and the nozzle of the second burner extends through the body of the ring at an edge of the glow element.

18. A lighter according to claim 1, wherein the first burner has a burner ring surrounding the glow element and the nozzle of the second burner extends to within the ring.

19. A lighter according to claim 1, wherein the two valves, and hence the blue and luminous flames, are independently adjustable.

* * * * *